US010988823B2

(12) United States Patent
Kawano

(10) Patent No.: US 10,988,823 B2
(45) Date of Patent: Apr. 27, 2021

(54) ANNEALED STEEL MATERIAL AND METHOD FOR MANUFACTURING THE SAME

(71) Applicant: DAIDO STEEL CO., LTD., Nagoya (JP)

(72) Inventor: Masamichi Kawano, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 157 days.

(21) Appl. No.: 15/936,088

(22) Filed: Mar. 26, 2018

(65) Prior Publication Data

US 2018/0282832 A1 Oct. 4, 2018

(30) Foreign Application Priority Data

Mar. 28, 2017 (JP) ..... JP2017-063911
Jan. 12, 2018 (JP) ..... JP2018-003470

(51) Int. Cl.
*C21D 1/32* (2006.01)
*C21D 9/00* (2006.01)
(Continued)

(52) U.S. Cl.
CPC ..... *C21D 9/0068* (2013.01); *C21D 1/26* (2013.01); *C21D 1/32* (2013.01); *C21D 1/785* (2013.01); *C21D 6/002* (2013.01); *C21D 6/004* (2013.01); *C21D 6/005* (2013.01); *C21D 6/007* (2013.01); *C21D 6/008* (2013.01); *C22C 38/001* (2013.01); *C22C 38/02* (2013.01); *C22C 38/04* (2013.01); *C22C 38/06* (2013.01); *C22C 38/20* (2013.01);
(Continued)

(58) Field of Classification Search
CPC .... C21D 1/26; C21D 2211/005; C21D 6/002; C21D 9/0068; C22C 38/001; C22C 38/46
USPC ..... 148/334
See application file for complete search history.

(56) References Cited

U.S. PATENT DOCUMENTS

2016/0348202 A1 12/2016 Nakano

FOREIGN PATENT DOCUMENTS

CN 101921958 A * 12/2010 ..... C22C 38/22
CN 101921958 A 12/2010
(Continued)

OTHER PUBLICATIONS

NPL: on-line translation of JP5093118B2, Dec. 2012 (Year: 2012).*
(Continued)

*Primary Examiner* — Jie Yang
(74) *Attorney, Agent, or Firm* — McGinn I.P. Law Group, PLLC.

(57) ABSTRACT

The present invention provides an annealed steel material having a composition containing, in mass %, 0.28≤C≤0.42, 0.01≤Si≤1.50, 0.20≤Mn≤1.20, 4.80≤Cr≤6.00, 0.80≤Mo≤3.20, 0.40≤V≤1.20, and 0.002≤N≤0.080, with the balance being Fe and unavoidable impurities; in which the annealed steel material has a cross-sectional size of a thickness of 200 mm or more and a width of 250 mm or more, and a hardness of 100 HRB or less; and in which a diameter of a largest ferritic grain observed in a microstructure is 120 μm or less in terms of a perfect circle equivalent, an area ratio of carbides is 3.0% or more and less than 10.5%, and an average particle diameter of the carbides is 0.18 μm or more and 0.29 μm or less.

14 Claims, 7 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/42*** | (2006.01) |
| ***C22C 38/44*** | (2006.01) |
| ***C22C 38/46*** | (2006.01) |
| ***C22C 38/60*** | (2006.01) |
| ***C21D 6/00*** | (2006.01) |
| ***C22C 38/22*** | (2006.01) |
| ***C22C 38/24*** | (2006.01) |
| ***C22C 38/20*** | (2006.01) |
| ***C21D 1/78*** | (2006.01) |
| ***C21D 1/26*** | (2006.01) |

(52) U.S. Cl.

CPC ..... *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/42* (2013.01); *C22C 38/44* (2013.01); *C22C 38/46* (2013.01); *C22C 38/60* (2013.01); *C21D 2211/004* (2013.01); *C21D 2211/005* (2013.01)

(56) References Cited

FOREIGN PATENT DOCUMENTS

| | | | | |
|---|---|---|---|---|
| CN | 101921959 | A | 12/2010 | |
| CN | 103173597 | B | 5/2014 | |
| EP | 2 270 245 | A1 | 1/2011 | |
| EP | 2 270 246 | A1 | 1/2011 | |
| JP | H 06-145884 | A | 5/1994 | |
| JP | 2002-332521 | A | 11/2002 | |
| JP | 2003-226939 | A | 8/2003 | |
| JP | 2007-056289 | A | 3/2007 | |
| JP | 5093118 | B2 * | 12/2012 | ..... C21D 1/20 |
| JP | 2014-025103 | A | 2/2014 | |

OTHER PUBLICATIONS

NPL: On-line translation of JP2002332521A, Nov. 2002 (Year: 2002).*

NPL: on-line translation of CN 101921958 A, Dec. 2010 (Year: 2010).*

Korean Office Action, dated Jun. 10, 2019, in Korean Application No. 10-2018-0036011 and Engish Translation thereof.

Denki-seiko (Electric Furnace Steel), vol. 76, No. 4 (2005), p. 287, with English Abstract.

Extended European Search Report dated Aug. 7, 2018 for European Patent Application No. 18164504.5.

Ryaposov I.V. et al: "Formation of grain and lath structure in low-carbon martensitic steels by heat cycling", Metal Science and Heat Treatment, Springer, New York, NY, US, vol. 50, No. 9-10, Jan. 1, 2008 (Jan. 1, 2008), pp. 435-441.

Guempel Paul et al: "Carbide segregations in hot-work steel X38CrMoV51 (Thyrotherm 2343)", Technische Berichte—Thyssen Edelstahl, Thyssen Edelstahlwerke, Krefeld, DE, vol. 11, No. 2, Jan. 1, 1985 (Jan. 1, 1985),pp. 143-149.

Kang Minwoo et al: "The effects of annealing temperature and cooling rate on carbide precipitation behavior in H13 hot-work tool steel", Journal of Alloys and Compounds, Elsevier Sequoia, Lausanne, CH, vol. 627, (Dec. 27, 2014), pp. 359-366.

Guempel Paul et al: "Carbide segregations in hot work tool steels", Archiv Fuer Das Eisenhuettenwesen, Verlag Stahleisen MBH, Duesseldorf, DE, vol. 55, No. 10, Jan. 1, 1984 (Jan. 1, 1984), pp. 493-498.

Berns Hans et al: "Effect of annealed structure on the toughness of hot-work steels . . . on the toughness of hot-work steels", Technische Berichte-Thyssen Edelstahl, Thyssen Edelstahlwerke, Krefeld, DE, vol. 11,No. 2, (Jan. 1, 1985), pp. 150-157.

Chinese Office Action, dated Oct. 12, 2019, in Chinese Application No. 201810263370.2 and English Translation thereof.

Chinese Office Action, dated Mar. 16, 2020 in Chinese Application No. 201810263370.2 and English Translation thereof.

Notification of the Decision of Rejection, dated Aug. 7, 2020, in Chinese Application No. 20180263370.2 and English Translation thereof.

"Heat Treatment Technology", Shaanxi Mechanical Engineering Institue, An Yunzheng, p. 57, China Machine Press, Jul. 31, 1982.

"Cold Extrusion Technology" Compilation Group, p. 281, Shanghai People's Publishing House, Jun. 30, 1976.

"Engineering Materials and Heat Treatment", He Renkui, p. 125, Metallurgical Industry Press, Jul. 31, 2015.

"Materials for Mechanical Engineering (2nd Edition)", Yu Hong et al., p. 73, Beijing University of Aeronautics and Astronautics Press, Aug. 31, 2011.

* cited by examiner

ANNEALED STEEL MATERIAL AND METHOD FOR MANUFACTURING THE SAME

TECHNICAL FIELD

The present invention relates to an annealed steel material and a method for manufacturing the same. Particularly, the present invention relates to an annealed steel material, which is free of generation of coarse austenitic grains at quenching temperature and is suitable for use as a material of a hot work tool such as a die, and relates to a method for manufacturing the annealed steel material.

BACKGROUND ART

A die-casting die is used, for example, in a quenching and tempering state. The die-casting die is required to hardly break during use and be long-lasting. The reason for this is because if a die cracks in an early period, production is stopped for replacing the die, resulting in the decrease of productivity. In addition, a new die for replacement must be manufactured, leading to the increase in costs. This is another reason.

The die-casting die hardly breaking can be achieved by increasing impact value. As one example, according to Non-Patent Document 1 described below, a die having an impact value of 20 J/cm$^2$ or more is considered to hardly break during use and thus, a die is conventionally required to have an impact value exceeding 25 J/cm$^2$ from the standpoint of safety. The impact value used herein means a value obtained by dividing absorbed energy (J) evaluated by U notched impact test piece (width of test piece: 10 mm, height of test piece: 10 mm, height under notch: 8 mm, notch bottom radius: 1 mm) by a cross-sectional area (0.8 cm$^2$) of the test piece.

FIG. 1 is a graph showing the relationship between an impact value and an austenitic grain size at quenching temperature before martensitic transformation in a JIS SKD61 material having a tempered hardness after martensitic transformation of 45 HRC. As is shown in FIG. 1, in the case where the austenitic grain size at quenching is large, the impact value decreases. Therefore, it is necessary to make finer the austenitic grain size at quenching temperature in order to increase the impact value.

Accordingly, high impact value is required in the die-casting die, and high impact value is achieved as the austenitic grain size at quenching temperature is finer. On the other hand, there is an increased risk of austenitic grains growing and coarsening as heating temperature is high and holding time is long. In the light of this, attention has been paid to the heating temperature and holding time when quenching such that austenitic grains do not grow large. In the case of JIS SKD61 material, when quenching, the heating temperature is appropriately 1,020° C. to 1,040° C., and the holding time is appropriately 30 minutes to 6 hours.

Patent Document 1 described below discloses a hot working die: comprising, in weight %, C: 0.42% to 0.55%, Si: 1.20% or less, Mn: 0.1% to 1.5%, Cr: 4.05% to 6.50%, at least one of W and Mo: 1.0% to 3.0% in terms of ½W+Mo, and V: 0.2% to 1.5%, with the balance being Fe and unavoidable impurities; having an area ratio of carbides, which have not entered into solid solution and have a particle diameter of 0.15 μm or more, being 2% or more; and having the number of carbide being 200 or more in 2,400 μm$^2$.

Patent Document 1: JP-A-H06-145884
Patent Document 2: JP-A-2003-226939
Non-Patent Document 1: Denki-seiko (Electric Furnace Steel), Vol. 76, No. 4 (2005), p 287

SUMMARY OF THE INVENTION

However, even though the heating temperature and holding time for quenching are appropriate, large austenitic grains (with a diameter exceeding 100 μm in terms of a perfect circle equivalent) are generated in some cases at quenching temperature. In this case, it is not that the whole surface of the structure becomes coarse grains, but mixed grain structure containing fine grains (with a diameter of 35 μm or less in terms of a perfect circle equivalent) and coarse grains in a mixed state is formed in many cases, which has low impact value. Example of the microstructure after quenched then tempered is shown in FIG. 2.

FIG. 2 shows the microstructure of a die-casting die formed of a JIS SKD61 material thermally refined to have a hardness of 47HRC by quenching and tempering and having cracks generated in an early stage (the microstructure is etched with an acid). Quenching conditions of this die is the heating temperature of 1,030° C. and the holding time of 4.5 hours, which are within appropriate conditions. However, this die has an impact value of low as 9 J/cm$^2$, which corresponds to the fact that the die has cracked in an early stage.

In FIG. 2, a white needle-like structure is bainite. The bainite cannot grow into neighbor grains beyond austenitic grain boundary. Therefore, a size of austenitic grains at quenching (which is also called "prior austenitic grains" in structure observation after quenching) can be estimated from a length of "needles" of bainite structure. Black line (indicated by A in FIG. 2) appeared in FIG. 2 is prior austenitic grain boundary, and it is clearly understood that the prior austenitic grains (austenitic grains at quenching temperature) are coarse in a region in which "needles" of bainite structure are remarkable. As a result of the evaluation in a wider visual field, the size of one coarse grain exceeded 100 μm.

Fine grains (indicated by B in FIG. 2) are also present in the structure of FIG. 2. Fine grains dotted so as to surround coarse grains have small average particle diameter (a diameter in terms of a perfect circle equivalent) as 35 μm or less. However, even in the structure containing such fine grains, the impact value is decreased if coarse grains are present. The reason for this is because cracks are easy to be generated from the part of coarse grains or cracks generated in other part easily propagate the region of coarse grains. Even though most of grains are fine grains, if coarse grains are partly present, the area thereof acts as the "weakest portion", leading to a decrease in the impact value. In the case where prior austenitic grains having a diameter exceeding 100 μm in terms of a perfect circle equivalent are present, the impact value of the quenched and tempered material cannot be increased.

Even though the heating temperature for quenching is decreased (e.g., 1,010° C.) or the holding time in quenching is very shortened (e.g., 15 minutes) in order to suppress grains from growing, coarse austenitic grains as shown in FIG. 2 are generated in some cases. It is estimated from this fact that coarse austenitic grains are not generated by the growth of grains during heating for quenching.

Memory effect may be considered as a generation mechanism of coarse austenitic grains. This is a kind of "memory effect of grain boundary" that in case where annealing has been conducted at a temperature far lower than Ac3 transformation point, when an annealed material is heated for quenching, austenite grain boundary at quenching locates in the same position as ferritic grain boundary of the annealed material.

However, if the annealing is conducted as a temperature exceeding [Ac3 transformation point −20° C.], the memory effect is not developed and an annealed material should become fine grains when quenching. In fact, the annealed material of FIG. 2 used in quenching had been subjected to spheroidizing annealing at 900° C. (cooling to 600° C. in a rate of 15° C./hr), which means that it had been treated at a temperature exceeding 890° C. that is Ac3 transformation point of JIS SKD61 material. Therefore, it is difficult to perform further measures under the present circumstances.

The measures are particularly difficult because it is not that coarse grains as shown in FIG. 2 are generated "at all times" and "in the whole sites in a cross-section of a die". When a die cracked in an early stage is examined, in some cases, coarse grain part is observed only in the vicinity of the cracked site and almost all of other regions are fine grain microstructure.

As mentioned above, in a conventional technique, measures for stably keeping a fine grain state of austenitic structure of a die-casting die at quenching temperature, thereby securing an impact value after quenching and tempering and avoiding cracks during using the die, are not performed sufficiently. The problem of cracks in an early stage by coarse grains is particularly remarkable in a large-sized die.

The present invention has been made in view of the above circumstances, and an object thereof is to provide an annealed steel material having a large cross-section, capable of being free of the generation of coarse austenitic grains at quenching temperature, and a method for manufacturing such an annealed steel material.

An annealed steel material of the present invention has a composition containing, in mass %:

$0.28 \leq C < 0.42$,
$0.01 \leq Si \leq 1.50$,
$0.20 \leq Mn \leq 1.20$,
$4.80 \leq Cr \leq 6.00$,
$0.80 \leq Mo \leq 3.20$,
$0.40 \leq V \leq 1.20$, and
$0.002 \leq N \leq 0.080$,
with the balance being Fe and unavoidable impurities;

in which the annealed steel material has:

a cross-sectional size of a thickness of 200 mm or more and a width of 250 mm or more, and a hardness of 100 HRB or less; and in which when a cross-section of the annealed steel material is polished and etched with an acid to expose metallic structure, a diameter of a largest ferritic grain observed in the metallic structure is 120 μm or less in terms of a perfect circle equivalent, an area ratio of carbides is 3.0% or more and less than 10.5%, and an average particle diameter of the carbides is 0.18 μm or more and 0.29 μm or less.

Here, the "annealed steel material" used herein means a steel material having a microstructure in an annealed state with low hardness. The ferritic grains used herein mean grains identified by contrast of color tone and clear line-shaped grain boundary when etching a polished material surface with an acid to expose microstructure and observing its microstructure with an optical microscope in 50 to 200 magnifications. In the case where the contrast of grains and the grain boundary are unclear, an analysis of crystal orientation is performed to identify grains. In this case, ferritic grain boundary in which orientation difference between the adjacent grains is an angle of 15° or more is defined as grain boundary.

The microstructure of the annealed steel material in which the ferritic grain boundary has been clarified by the above procedures is observed in a wide visual field (the whole cross-section of the steel material or a representative part therein), and the largest ferritic grain therein is selected. A ferritic grain is not a perfect circle but has a polygonal or indeterminate form. An area of the largest grain selected is obtained by image processing or the like, and a diameter of a circle having an area equal to that of the ferritic grain (perfect circle equivalent diameter) is calculated. This is a diameter of the ferritic grain in terms of a diameter of a perfect circle equivalent.

The area ratio (%) of carbides used herein is a value obtained by area ratio (%)=100×s/A from the total area "s" of carbides present in the cumulative area A (4,000 $\mu m^2$ to 5,000 $\mu m^2$) of plural visual fields observed in 5,000 magnifications.

The average particle diameter (μm) of carbides used herein is a diameter of a perfect circle in the case where average area C=s/n is calculated from the total area "s" of carbides present in the cumulative area (4,000 $\mu m^2$ to 5,000 $\mu m^2$) of plural visual fields observed in 5,000 magnifications and the total number "n" of carbides and a perfect circle having the area of C is assumed.

Here, annealed steel material generally contains the following components as unavoidable impurities within the following ranges in mass %:

$P \leq 0.05$,
$S \leq 0.008$,
$Cu \leq 0.30$,
$Ni \leq 0.30$,
$Al \leq 0.10$,
$O \leq 0.01$,
$W \leq 0.30$,
$Co \leq 0.30$,
$Nb \leq 0.004$,
$Ta \leq 0.004$,
$Ti \leq 0.004$,
$Zr \leq 0.004$,
$B \leq 0.0001$,
$Ca \leq 0.0005$,
$Se \leq 0.03$,
$Te \leq 0.005$,
$Bi \leq 0.01$,
$Pb \leq 0.03$,
$Mg \leq 0.02$,
$REM \leq 0.10$, and the like.

The annealed steel material of the present invention may further contain, in mass %, at least one of:

$0.30 \leq Cu \leq 1.00$ and
$0.30 \leq Ni \leq 1.50$.

The annealed steel material of the present invention may further contain, in mass %:

$0.0001 \leq B \leq 0.0050$.

The annealed steel material of the present invention may further contain, in mass %, at least one of:

$0.30 \leq W \leq 5.00$ and
$0.30 \leq Co \leq 4.00$.

The annealed steel material of the present invention may further contain, in mass %, at least one of:

$0.004 \leq Nb \leq 0.100$,
$0.004 \leq Ta \leq 0.100$, 0.004≤Ti≤0.100, and 0.004≤Zr≤0.100.

The annealed steel material of the present invention may further contain, in mass %:

0.10≤Al≤1.50.

The annealed steel material of the present invention may further contain, in mass %, at least one of:

0.008≤S≤0.200, 0.0005≤Ca≤0.2000, 0.03≤Se≤0.50, 0.005≤Te≤0.100, 0.01≤Bi≤0.50, and 0.03≤Pb≤0.50.

A method for manufacturing an annealed steel material of the present invention is a method for manufacturing the above-mentioned annealed steel material, which contains performing a plural times of an annealing treatment on a steel material in which the annealing treatment contains heating the steel material to a temperature exceeding [Ac3 transformation point −20° C.] and [Ac3 transformation point +60° C.] or lower.

Die-casting die is produced by machining a steel material as a raw material, followed by quenching and tempering the steel material. The steps of producing a die contains, in this order, melting and refining, casting, homogenizing, hot plastic working, (intermediate heat treatment), annealing, machining, quenching, and tempering. The intermediate heat treatment may not be conducted depending on a size of a target steel material.

The present inventors examined the influence of "microstructure before annealing and annealing conditions" affecting austenitic grain size at quenching temperature and traced the generation of coarse grains. As a result, they ascertained that (1) in the case where coarse grains are present in an annealed steel material, austenitic microstructure at quenching temperature cannot be graded and refined, (2) in the case where the microstructure before annealing (microstructure after hot plastic working) is coarse, coarse grains are generated in the annealed steel material through one annealing treatment, and (3) the above tendency is remarkable in the case where the annealing is conducted at a temperature lower than Ac3 transformation point. It has been succeeded in the present invention to stably refine the microstructure of the annealed steel material into fine grains by utilizing those findings.

Specifically, even though the microstructure before annealing (microstructure after hot plastic working) is coarse, the largest ferritic grain size observed in the annealed steel material can be 120 μm (diameter in terms of a perfect circle equivalent of one grain) or less by repeating an annealing treatment in a temperature region just around Ac3 transformation point or exceeding Ac3 transformation point several times, thereby suppressing the generation of austenitic grains exceeding 100 μm at quenching temperature.

Here, the composition described in Patent Document 1 overlaps that of the present invention in Cr, Mo and the like. However, the content of C that is the most important element in a steel is 0.42% or more in Patent Document 1, which differs from 0.28≤C<0.42 in the present invention. In the case where the C content excessively increases, coarse carbides having a size of 5 μm or more easily generate in agglomeration, and the resulting coarse carbides are easy to become the crack initiation points during using as a die. In addition, in the case where the C content excessively increases, cracks easily generate in a die when repairing the die by welding. For these reasons, the C content is set to less than 0.42% in the present invention. In addition, "suppression of plastic flow at die surface during hot working" as the object of the technique disclosed in Patent Document 1 quite differs from "refinement of austenitic grains at quenching" as an object of the present invention. The reason for this is because plastic flow is not influenced by austenitic grains at quenching temperature.

Patent Document 2 defines the structure in an anneal state, similar to the present invention. However, Patent Document 2 requires a high area ratio of carbides as 10.5% or more, which differs from less than 10.5% in the present invention. The present invention of C<0.42% can reduce the crack initiation points of a die and simultaneously secure a weld repairing property, without excessively generating carbides. Furthermore, Patent Document 2 improves machinability together with the improvement in erosion loss and heat check resistance, but this quite differs from "refinement of austenitic grains at quenching temperature" as an object of the present invention. The reason for this is because erosion loss, heat check resistance and machinability are not influenced by austenitic grains at quenching temperature. The opinion is deeply rooted that the origin of heat check of martensite structure is in prior austenitic grain boundary. However, as a result of detailed observation of propagation path of cracks in an early stage of its generation, it has been proved that the origin is not breakage in prior austenitic grain boundary.

According to the present invention, an annealed steel material having a large cross-section and capable of suppressing the generation of coarse austenitic grains at quenching temperature, and a method for manufacturing the annealed steel material can be provided.

MODES FOR CARRYING OUT THE INVENTION

Figure 1:
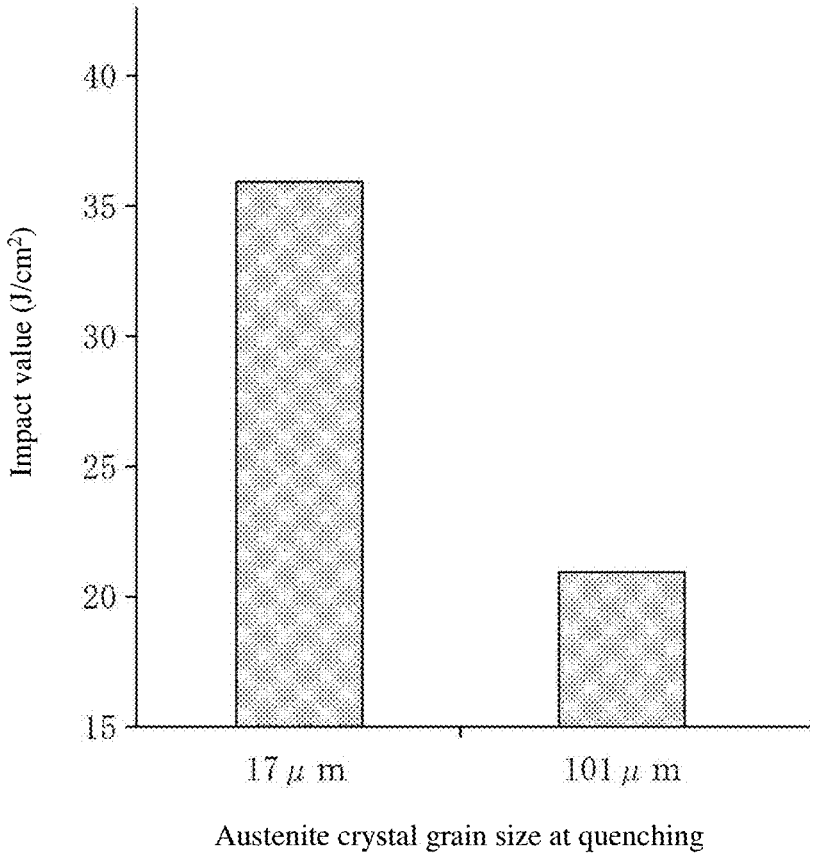
FIG. 1 is a graph showing the relationship between an impact value of quenched then tempered condition and austenitic grain size.
Figure 2:
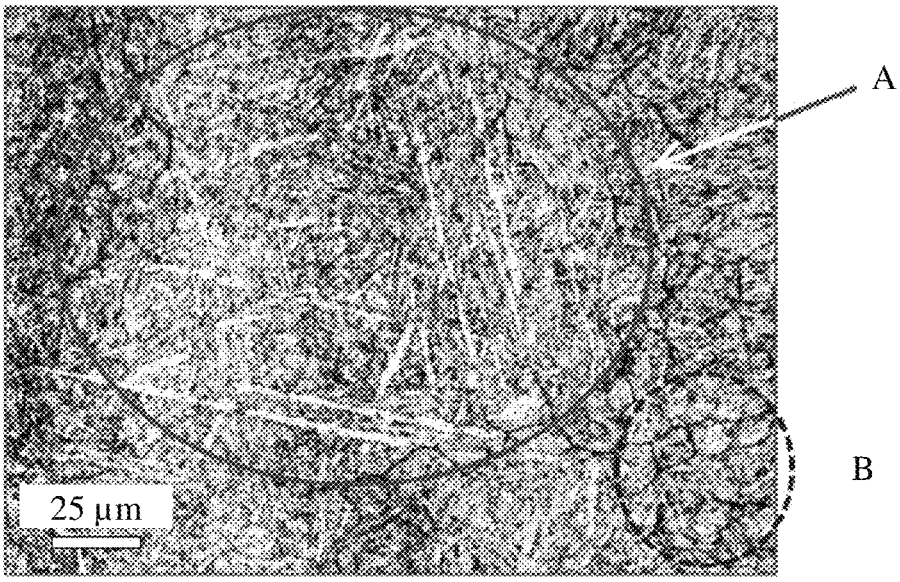
FIG. 2 is a micrograph showing the microstructure of a die having cracks generated in an early stage.
Figure 3A:
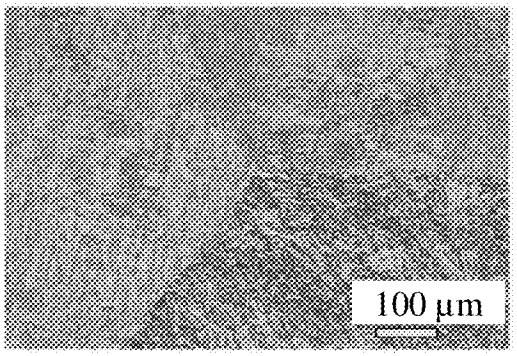
FIGS. 3A to 3D are micrographs showing the microstructures of a steel material changing by annealing and quenching.
Figure 3B:
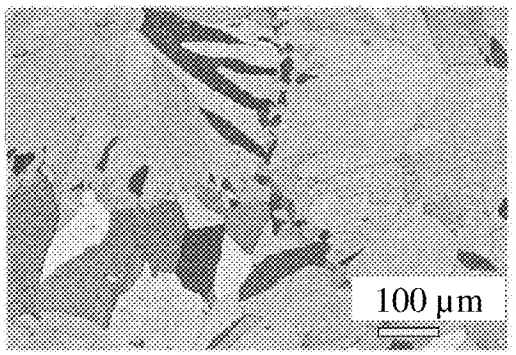
Figure 3C:
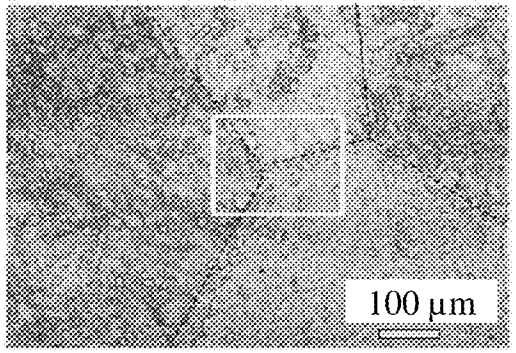
Figure 3D:
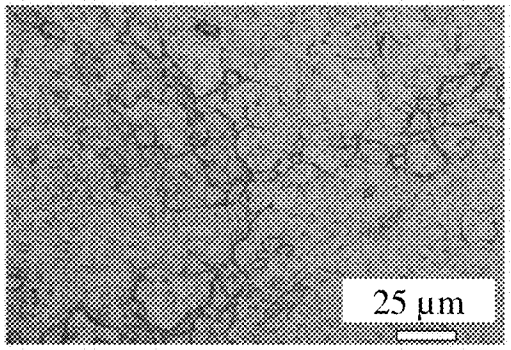

A method for creating the structure of the present invention is described below. FIGS. 3A to 3D are micrographs showing the state that the microstructure of JIS SKD61 material changes by annealing and quenching. FIG. 3A shows a microstructure of the steel material before annealing, which has been subjected to a heating at 1,240° C. simulating a hot plastic working, followed by being cooled to room temperature and then subjected to an intermediate heat treatment of being heated to 680° C. that is lower than Ac1 transformation point. FIG. 3B shows a microstructure after the steel material in the state of FIG. 3A is annealed one time at 900° C. that exceeds Ac3 transformation point (cooled from 900° C. to 600° C. in a rate of 15° C./hr). The microstructure of FIG. 3B is in a soft state in which spheroidized carbides are dispersed in a matrix of ferrite. It is observed in FIG. 3B the state where the influence of coarse prior microstructure (FIG. 3A) clearly remains, fine ferritic grains are present in a dotted line shape in the vicinity of the grain boundary, and columnar coarse ferritic grains extend toward the inside of coarse grains from the grain boundary. The coarse ferritic grains have a diameter exceeding 120 μm when its area is converted to a perfect circle by image processing. FIG. 3C shows a quenched microstructure obtained by heating the annealed material of FIG. 3B to 1,030° C., maintaining the annealed material for 1 hour at this temperature and rapidly cooling to form martensite. FIG. 3D is an enlarged view of a square section surrounded by a solid line in the vicinity of the center of visual field of FIG. 3C. The broken line in FIG. 3C is the prior austenitic grain boundary. In other words, FIG. 3D is an enlarged view of a cross point of the prior austenitic grain boundary. Fine grains are interspersed in the prior austenitic grain boundary of the quenched microstructure, and its average grain size (diameter in terms of a perfect circle equivalent) is small as 35 μm or less. On the other hand, fine grains are also interspersed in the coarse prior austenitic grains in an isolated island state. When an area of a region obtained by removing the grain boundary and fine grains from one coarse grain is converted to a perfect circle, the diameter of the coarse prior austenitic grain exceeds 100 μm.

Figure 4A:
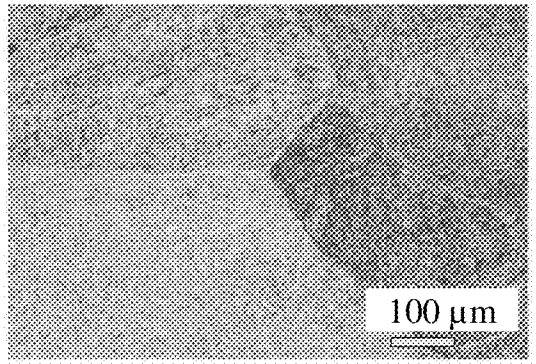
FIGS. 4A to 4D are micrographs showing the microstructures of a steel material under annealing conditions different from those in FIGS. 3A to 3D.
Figure 4B:
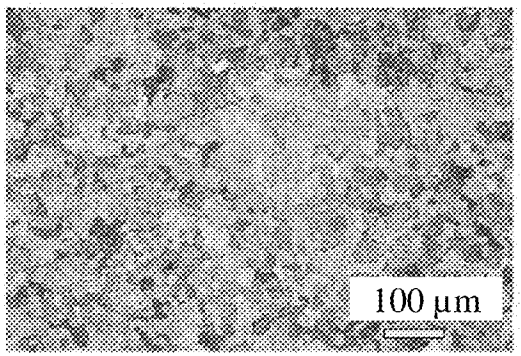
Figure 4C:
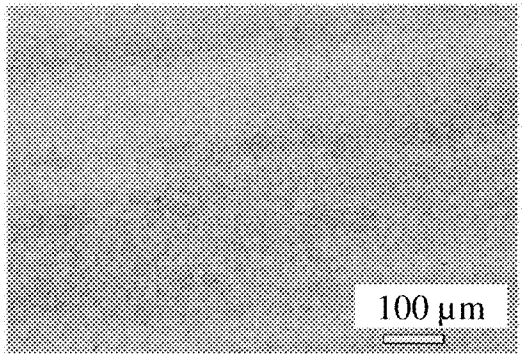
Figure 4D:
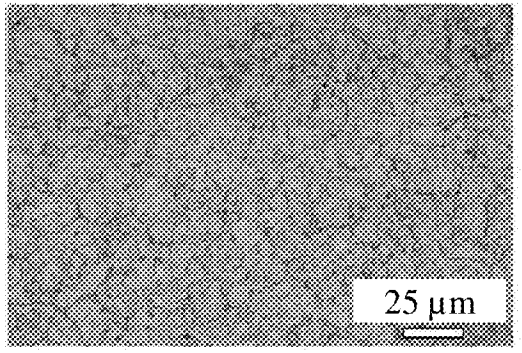

FIGS. 4A to 4D show the case where the same experiments as in FIGS. 3A to 3D were conducted except that the annealing treatment at 900° C. was repeated three times in total. FIG. 4A shows a microstructure of the steel material before annealing, and does not basically differ from FIG. 3A. FIG. 4B shows a microstructure after the steel material in the state of FIG. 4A is repeatedly subjected to the annealing treatment at 900° C. three times in total. The microstructure of FIG. 4B clearly differs from that of FIG. 3B and is a graded fine grain structure of fine ferritic matrix, and the diameter of the ferritic grain is small as less than 100 μm. FIGS. 4C and 4D show a quenched microstructure obtained by heating the annealed steel material having such a fine ferritic structure to 1,030° C., maintaining the annealed steel material for 1 hour and rapidly cooling to form martensite. The quenched microstructure shown in FIGS. 4C and 4D differs from the case of FIGS. 3C and 3D, and is a graded fine grain microstructure. The average grain size is small as 35 m or less, and such coarse grains as exceeding 100 μm are not present. Thus, FIGS. 4C and 4D show extremely desirable state as the quenched microstructure.

Figure 5A:
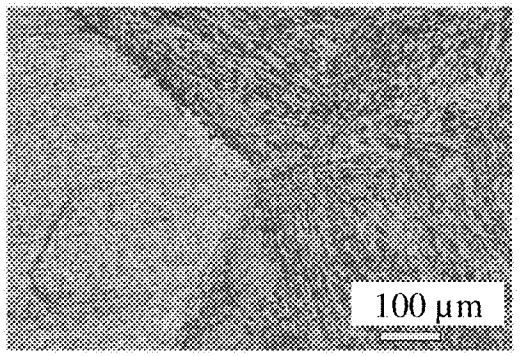
FIGS. 5A to 5D are micrographs showing the microstructures of a steel material under annealing conditions different from those in FIGS. 3A to 3D and 4A to 4D.
Figure 5B:
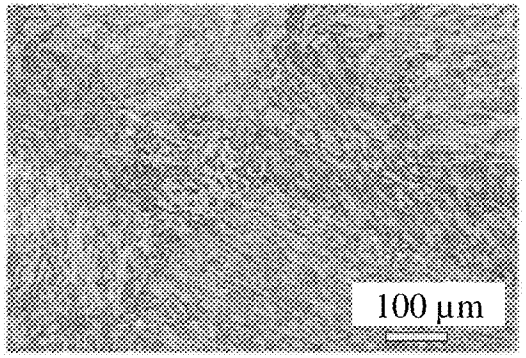
Figure 5C:
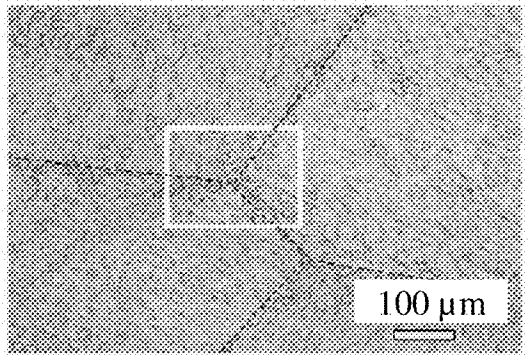
Figure 5D:
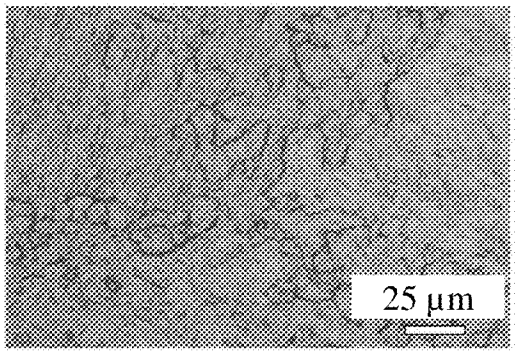

FIGS. 5A to 5D shows the case where the same experiments as in FIGS. 4A to 4D were conducted except that the annealing temperature was changed to 860° C. FIG. 5A shows a microstructure of the steel material before annealing, and does not basically differ from FIG. 3A and FIG. 4A. FIG. 5B shows a microstructure after the steel material in the state of FIG. 5A is repeatedly subjected to an annealing treatment at 860° C. three times in total. The annealed microstructure shown in FIG. 5B, however, does not almost change from FIG. 5A before annealing. The annealed microstructure quite differs from FIG. 3B and FIG. 4B, and there is an impression that a matrix seems to be martensite or bainite tempered at high temperature, rather than ferrite. FIGS. 5C and 5D show a quenched structure obtained by heating the coarse annealed steel material of FIG. 5B to 1,030° C., maintaining the annealed steel material at 1 hour and rapidly cooling to form martensite. FIG. 5D is an enlarged view of a square section surrounded by a solid line in the vicinity of the center of the visual field of FIG. 5C. The broken line in FIG. 5C is the prior austenitic grain boundary. In other words, FIG. 5D is an enlarged view of a cross point of the prior austenitic grain boundary. Fine grains are interspersed in the prior austenitic grain boundary of the quenched microstructure, and its average grain size is small as 35 μm or less. On the other hand, fine grains are also interspersed in the coarse prior austenitic grains in an isolated island state. When an area of a region obtained by removing the grain boundary and fine grains from one coarse grain is converted to a perfect circle, the diameter of the coarse prior austenitic grains exceeds 100 μm. Rather, the diameter does not almost differ from very large grain size before annealing.

As described above, even though the grains before annealing (structure after hot plastic working) are coarse, if the largest ferritic grain size observed in the annealed steel material is made 120 μm or less by repeating an annealing treatment in a temperature region just around Ac3 transformation point or exceeding Ac3 transformation point several times, coarse austenitic grains exceeding 100 μm can be suppressed from being generated at quenching temperature.

The size of fine grains (interspersed so as to surround coarse grains) observed in the quenched structures of FIGS. 2 to 5D above was 35 μm or less. However, the size of fine grains varies depending on the state of the annealed microstructure and the quenching conditions, and the size of "35 μm or less" is merely one example. The size of fine grains may be 55 μm or less or 75 μm or less. It is important that the size of coarse grains observed in the quenched microstructure does not exceed 100 μm in order to secure an impact value required in a die and the like.

In addition, highly reliable reasoning became possible to the position that coarse grains are not generated "at all times" and "in the whole sites in a cross-section of a die". Specifically, the part at which coarse grains are generated at quenching is the "coarse grain part at hot plastic working". There are two pertinent parts. One is the vicinity of the center of a material having large cross-section, and the other is a dead metal zone (a site at which a temperature decreases due to the contact with a tool and deformation becomes very small due to the superposition with a large friction coefficient) in a surface side of the material. Particularly, it is difficult to predict the place of a material on which the dead metal zone is to be generated. For this reason, it is also difficult to predict the place on which coarse grain part is to be generated at quenching. Furthermore, in many cases, a part is cut out of a material having a large cross-section to manufacture a die. In this case, it appears that if the dead metal zone or the vicinity of the center of a material is accidentally cut, coarse grains are generated at quenching.

So far as inhomogeneity of the microstructure is unavoidably present in a hot plastic worked material, repeating an annealing treatment at a temperature in the vicinity of Ac3 transformation point several times is an essential requirement to stably obtain the fine grain structure at quenching.

The annealing temperature is set [Ac3 transformation point −20° C.]<annealing temperature≤[Ac3 transformation point +60° C.]. In the case where the annealing temperature is excessive low, the phenomenon shown in FIGS. 5A to 5D is easy to be developed. In the case where the annealing temperature is excessively high, the amount of insoluble carbides (insoluble carbides serving as nuclei when carbides are spheroidized) decreases, making it difficult to perform softening and thus, a cooling rate to a predetermined temperature (e.g., 600° C.) must make smaller. This is inefficient. In the case of JIS SKD61 material, the annealing temperature is desirably 880° C. to 930° C.

Steels with lower Si content or higher Mn content than that of JIS SKD61 steel have a low Ac3 transformation point. Therefore, the annealing temperature of these steels is preferably 830° C. to 910° C. The Ac3 transformation point intended in the present invention is a value in the case of heating in a rate of 100° C./hr to 200° C./hr.

In manufacturing the annealed steel material of the present invention, the recommendable number of the annealing treatment conducted in the above-mentioned temperature region is 2 to 5. The number of the annealing treatment must be increased as the initial structure is coarser. In the case where the number of the annealing treatment is excessively small, the phenomenon shown in FIGS. 3A to 3D is easy to be developed. On the other hand, excessive number of annealing treatment saturates the effect of refinement but leads to an increase in processing cost.

Sufficient effect (coarse austenitic grains exceeding 100 μm are not generated at quenching temperature) may be obtained even though the number of the annealing treatment is 2, depending on the structure state before annealing. However, to stably develop the effect, the number of the annealing treatment is preferably 3 or more.

The annealed steel material of the present invention can be applied to a steel material having a component system suitable for use in a die or parts for injection molding of plastics, molding and processing of rubbers, molding of carbon fiber reinforced plastics (CFRP), various casting, warm forging or hot forging, hot stamping and the like, in addition to that for the above-discussed die-casting die.

The reason for limiting each chemical component in the present invention is described below. The amount of each chemical component is expressed in mass %.

$0.28 \leq C < 0.42$

In the case of $C < 0.28$, hardness required as a die is difficult to be stably achieved when quenching rate is low and tempering temperature is high. Furthermore, in the case of $C < 0.28$, the amount of insoluble VC pinning austenitic grain boundary at quenching is excessively small, and austenitic grains cannot be maintained in fine state. In the case of $0.42 \leq C$, the amount of coarse carbides increases, which act as the crack initiation point. As a result, an impact value is decreased. Furthermore, in the case of $0.42 \leq C$, weldability is deteriorated. The C content is preferably $0.29 \leq C \leq 0.41$, and more preferably $0.30 \leq C \leq 0.40$, from the standpoint of excellent balance in various properties.

$0.01 \leq Si \leq 1.50$

In the case of $Si < 0.01$, machinability when machining is remarkably deteriorated. In the case of $1.50 < Si$, heat conductivity is greatly decreased. Furthermore, in the case of $1.50 < Si$, Ac3 transformation point is excessively high, heating temperature for an annealing must be increased, and much time is required for heating to the annealing temperature and cooling to the completion temperature. As a result, production efficiency is deteriorated. Furthermore, in the case of $1.50 < Si$, carbides become too large, and the effect of suppressing grain growth of austenite phase at quenching is insufficient. The Si content is preferably $0.02 \leq Si \leq 1.35$, and more preferably $0.03 \leq Si \leq 1.20$, from the standpoint of excellent balance in various properties.

When the amount of Si increases, carbides in the annealed steel material enlarge. This tendency is shown in FIG. 6.

Figure 6:
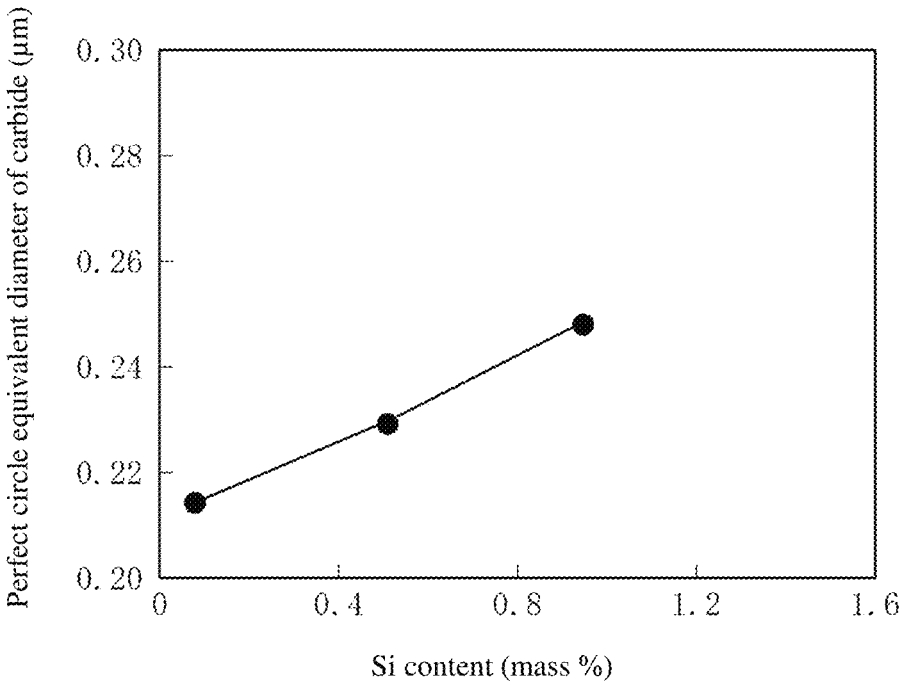
FIG. 6 is a graph showing the relationship between a size of carbide and Si content.

The material of FIG. 6 had main components of 0.38C-0.45Mn-5.20Cr-1.19Mo-0.91V-0.020N, and the amount of Si was changed in the basic components. The material underwent an annealing treatment of heating to 915° C. from room temperature and then cooling to 600° C. in a rate of 15° C./hr. An average size of spherical carbides uniformly dispersed in the annealed structure was obtained by image processing. FIG. 6 shows the relationship between the average size and Si content. A part of those carbides remains as insoluble carbides when quenching, and suppresses grain growth of austenitic grains due to the dispersion thereof.

The effect of suppressing grain growth is greatly influenced by a size of carbides. When an area ratio of carbides is the same, small-sized carbides have stronger effect of suppressing grain growth of austenite. Therefore, in the case where the amount of Si is excessive and a size of carbides is too large, grain growth of austenite at quenching cannot be suppressed. For this reason, it is important to specify the upper limit of the Si content.

$0.20 \leq Mn \leq 1.20$

In the case of $Mn < 0.20$, hardenability during quenching is insufficient, leading to the decrease in impact value due to the mixing of bainite. In the case of $1.20 < Mn$, annealing property is remarkably deteriorated, and the heat treatment for softening is complicated and requires much time, leading to an increase in production costs. Furthermore, in the case of $1.20 < Mn$, thermal conductivity is also greatly deteriorated. The Mn content is preferably $0.25 \leq Mn \leq 1.10$, and more preferably $0.35 \leq Mn \leq 1.00$, from the standpoint of excellent balance in various properties.

$4.80 \leq Cr \leq 6.00$

In the case of $Cr < 4.80$, hardenability during quenching and corrosion resistance are not sufficient. In a large die for die-casting or hot forging, the die must be completely quenched up to the inside thereof at which quenching rate is small (fully martensitic structure) to secure a high impact value. However, this requirement cannot be satisfied in the case of $Cr < 4.80$ because hardenability during quenching is not sufficient. Furthermore, in the case of $Cr < 4.80$, annealing property is remarkably deteriorated, and satisfactory annealing property required as a material for a die for die-casting or hot forging cannot be achieved.

On the other hand, in the case of $6.00 < Cr$, softening resistance and thermal conductivity are greatly deteriorated. In a die for die-casting or hot forging, high softening resistance is required such that strength is not deteriorated even when the die is brought into contact with a high temperature material to be worked and heated. This requirement cannot be satisfied in the case of $6.00 < Cr$. Also, high thermal conductivity required for the reduction of thermal fatigue of a die cannot be satisfied in the case of $6.00 < Cr$.

Many prior arts generally describe a wide Cr content such as "1 to 8%". However, for the reasons described above, the present invention specifies narrow range of $4.80 \leq Cr \leq 6.00$ that matches the actual working conditions of a die. The Cr content is preferably $4.90 \leq Cr \leq 5.90$, and more preferably $5.00 \leq Cr \leq 5.85$, from the standpoint of excellent balance in various properties.

$0.80 \leq Mo \leq 3.20$

In the case of $Mo < 0.80$, Mo cannot sufficiently contribute to secondary hardening, and in the case where tempering temperature is high, it is difficult to stably achieve high hardness. In the case of $3.20 < Mo$, annealing property is remarkably deteriorated. Furthermore, in the case of 3.20<Mo, fracture toughness is remarkably deteriorated, and cracking of a die is a concern. In the case of 3.20<Mo, material cost also remarkably increases. Furthermore, in the case of 3.20<Mo, Ac3 transformation point is excessively high and thus, heating temperature for an annealing treatment must be increased. As a result, much time is required for heating to the annealing temperature and cooling to the completion temperature, leading to a deterioration of production efficiency. The Mo content is preferably 0.90≤Mo≤3.15, and more preferably 1.00≤Mo≤3.10, from the standpoint of excellent balance in various properties.

Figure 7:
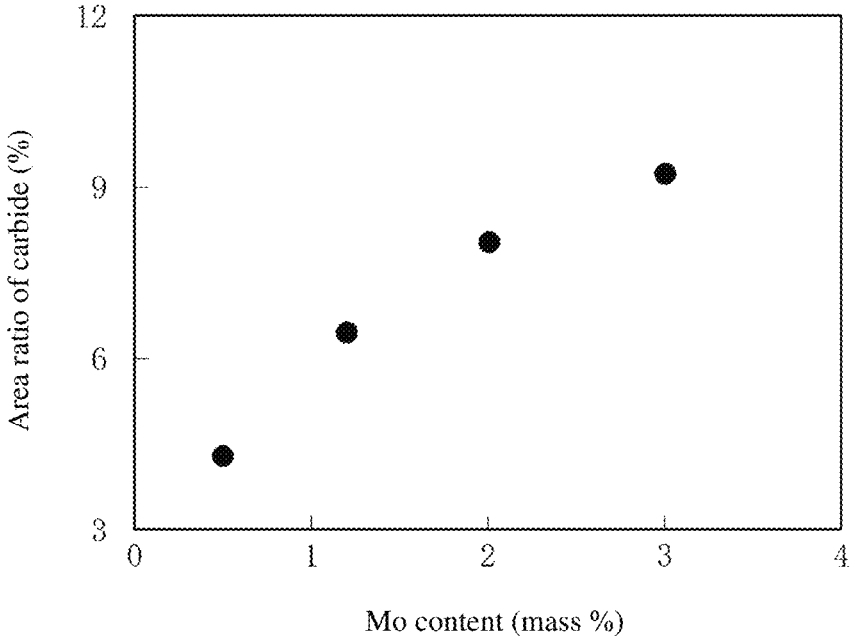
FIG. 7 is a graph showing the relationship between an area ratio of carbide and Mo content.

When the amount of Mo increases, the amount of carbides in an annealed material also increases. This tendency is shown in FIG. 7. The material of FIG. 7 had main components of 0.38C-0.95Si-0.46Mn-5.22Cr-0.92V-0.019N, and the amount of Mo was changed in the basic components. The material underwent an annealing treatment of heating to 915° C. from room temperature and then cooling to 600° C. in a rate of 15° C./hr. An area ratio of spherical carbides uniformly dispersed in the annealed structure was obtained by image processing. FIG. 7 shows the relationship between the area ratio and Mo content. A part of those carbides remains as insoluble carbides when quenching, and suppresses grain growth of austenite phase due to the dispersion thereof.

The effect of suppressing grain growth is also greatly influenced by an area ratio of carbides. When carbides have the same size, carbides having larger area ratio have stronger effect of suppressing grain growth of austenite. Therefore, larger amount of Mo is preferred from the standpoint of maintaining fine grains. On the other hand, if a component system is prepared for increasing the area ratio of carbides, coarse carbides of 5 μm or more are easy to be formed when solidifying, which remarkably deteriorates an impact value. For this reason, it is important to specify the upper limit of the Mo content in order to maintain fine grains and to avoid the generation of too much coarse carbides.

0.40≤V≤1.20

In the case of V<0.40, VC at quenching temperature is decreased. As a result, the effect of suppressing the coarsening of austenitic grains is poor. In the case of 1.20<V, the effect of maintaining fine grains is saturated, but cost increases. Furthermore, in the case of 1.20<V, the amount of coarse carbides of 5 μm or more (formed when solidifying) increases, which act as the crack initiation point. As a result, an impact value is deteriorated. The V content is preferably 0.44≤V≤1.15, and more preferably 0.48≤V≤1.10, from the standpoint of excellent balance in various properties.

0.002≤N≤0.080 In the case of N<0.002, VC at quenching temperature is decreased. As a result, the effect of suppressing the coarsening of austenitic grains is poor. Similar to C, Mo and V, N greatly affects insoluble VC amount at quenching temperature, and in the case of considering austenite grain size at quenching, N is an important element that cannot be ignored.

On the other hand, in the case of 0.080<N, the time and cost for refining required in N addition are increased, leading to an increase of material cost. Furthermore, in the case of 0.080<N, the amount of coarse nitrides increases, which act as the crack initiation point. As a result, toughness is deteriorated. The N content is preferably 0.005≤N≤0.060, and more preferably 0.008≤N≤0.045, from the standpoint of excellent balance in various properties.

Cross-Sectional Size: Thickness of 200 mm or More and Width of 250 mm or More

The annealed steel material of the present invention is mainly used in a large die, and therefore has a large cross-sectional size. One of the characteristics of the present invention is that coarse ferritic grains having a diameter exceeding 120 μm in terms of a perfect circle equivalent are not present even though a size of cross-section is large.

Figure 8:
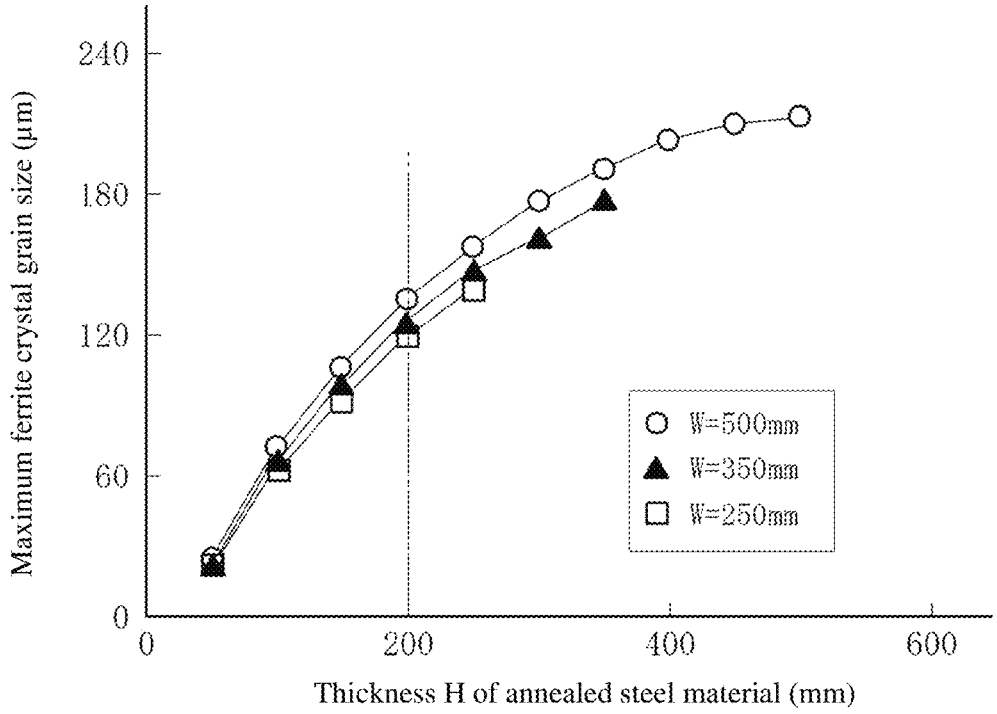
FIG. 8 is a graph showing the relationship between the largest ferritic grain size and a thickness of a steel material in an annealed steel material manufactured under the conventional annealing conditions.
Figure 9:
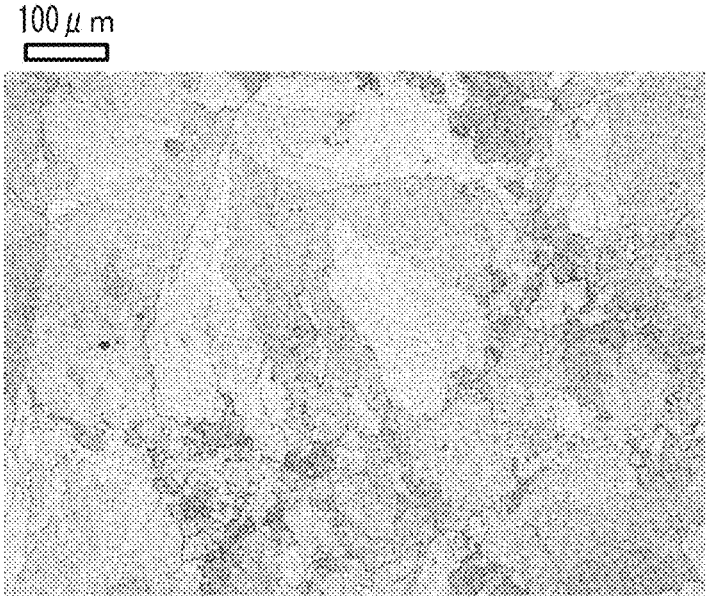
FIG. 9 is a micrograph showing the microstructure of the conventional annealed steel material.

FIG. 8 shows an influence of the thickness of an annealed steel material affecting the maximum ferritic grain size of the annealed steel material. This annealed steel material was manufactured by a conventional process different from the manufacturing method of the present invention. According to FIG. 8, although the width W of the annealed steel material affects the ferritic grain size, the thickness H of the steel material greatly affects the ferritic grain size. The thickness H of 200 mm or more and the width W of 250 mm or more are required to manufacture a large die, but the largest ferritic grain size exceeds 120 μm in this region. FIG. 9 shows one example of the case, and shows the structure of an annealed steel material having both thickness H and width W of 500 mm or more. The components of this steel material are 0.34C-0.09Si-1.04Mn-5.11Cr-1.83Mo-0.52V-0.015N.

The present invention overcomes the above-described problem that cannot be achieved by a conventional technique (the problem that austenitic grains are coarsened at quenching) by controlling the largest ferritic grain size to 120 μm or less in an annealed steel material having a cross-sectional size of thickness of 200 mm or more and width of 250 mm or more.

The directions of "thickness" and "width" mean directions perpendicular to the direction in which length has finally elongated when a material is subjected to hot plastic processing (so-called "fiber direction"). Of the two perpendicular directions, smaller direction is defined as "thickness" and larger direction is defined as "width". Even in the case where a steel material is cut out of very large material or long material and a fiber direction is unclear, the fiber direction can be judged from the microstructure. Specifically, a direction of segregation, distribution of inclusions, elongation direction of inclusions, and the like are evaluated.

Hardness: 100 HRB or Less

The annealed steel material of the present invention is to be subjected to a machining in a later stage, and is therefore required to be softened up to machinable state. For this reason, the present invention specifies the hardness to be 100 HRB or less.

Area Ratio of Carbides: 3.0% or More and Less than 10.5%

Average Grain Size of Carbides: 0.18 μm or More and 0.29 μm or Less

As noted above, a part of carbides remains as insoluble carbides at quenching temperature, and suppresses grain growth of austenitic grains due to the dispersion thereof. To achieve this effect, an average grain size of carbides in the annealed structure is controlled to 0.18 μm or more. On the other hand, coarse carbides become a factor of deteriorating an impact value. Therefore, the upper limit of the average grain size is set to 0.29 μm. The average grain size of carbides is preferably 0.185 μm or more and 0.280 μm or less.

Larger area ratio of carbides provides large effect of suppressing grain growth. However, in the case where the area ratio of carbides is excessively large, coarse carbides are easy to be formed, which becomes a factor of deteriorating an impact value. For this reason, the area ratio of carbides is controlled to 3.0% or more and less than 10.5%. The area ratio of carbides is preferably 3.2% or more and 10.0% or less.

Chemical Components: Cu and Ni

In order to improve hardenability during quenching, at least one element of Cu and Ni may be contained in amounts of, in mass %:

$0.30 \leq Cu \leq 1.00$, and $0.30 \leq Ni \leq 1.50$.

In the case where the amounts of those elements are excessively large, annealing property is deteriorated and thermal conductivity is also deteriorated. Furthermore, in the case where the amount of Cu exceeds 1.00%, cracking during hot plastic working becomes a problem.

Chemical Component: B

Addition of B is also effective as an improvement for hardenability during quenching. Specifically, B may be contained in an amount of:

$0.0001 < B \leq 0.0050$.

When B forms BN, the effect of improving hardenability during quenching is lost. Therefore, B is required to be present alone in a steel. Specifically, N is made to form a nitride with an element having strong affinity with N rather than B, so as to avoid B bonding to N. Examples of such an element include Nb, Ta, Ti and Zr. Those elements have the effect of fixing N even though they are present in the level of impurities, but those elements may sometimes be added in the amounts described below depending on the amount of N. Even though B bonds to N in a steel to form BN, if excessive B is present alone in a steel, the excessive B enhances hardenability during quenching.

B is also effective to improve machinability. The improvement in machinability can be achieved by forming BN. BN has properties similar to those of graphite, and decreases cutting resistance and simultaneously improves chip breakability. In the case where B and BN are present in a steel, hardenability during quenching and machinability are simultaneously improved.

Chemical Components: W and Co

W and Co are optionally added to secure strength without increasing the amount of C. W increases the strength due to the precipitation of carbides. Co increases the strength due to solid-solution in a matrix, and simultaneously contributes to precipitation hardening through the change of carbide form.

Specifically, at least one element of W and Co may be contained in amounts of, in mass %:

$0.30 < W \leq 5.00$, and $0.30 < Co \leq 4.00$.

Each element in an amount exceeding the predetermined amount leads to saturation of properties and remarkable increase in cost.

Chemical Components: Nb, Ta, Ti and Zr

When the heating temperature for quenching increases and/or the heating time for quenching is prolonged by unexpected facility troubles or the like, the deterioration of various properties due to the coarsening of grains is a concern. For such an occasion, Nb, Ta, Ti and/or Zr can be optionally added to form fine precipitates, whereby the coarsening of austenitic grains at quenching can be suppressed. Specifically, at least one element of Nb, Ta, Ti and Zr may be contained in amounts of, in mass %:

$0.004 < Nb \leq 0.100$, $0.004 < Ta \leq 0.100$, $0.004 < Ti \leq 0.100$, and $0.004 < Zr \leq 0.100$.

In the case where the amount of each element exceeds the predetermined amount, carbides, nitrides or oxides are excessively formed, leading to the deteriorations in the impact value and mirror polishability.

Chemical Component: Al

Al that forms AlN by bonding to N may be added in order to suppress growth of austenitic grains at quenching. Al has a high affinity with N and accelerates the penetration of N into a steel. Therefore, when a steel material containing Al is subjected to a nitriding treatment, surface hardness is liable to increase. Use of a steel material containing Al is effective for a die to which a nitriding treatment for higher wear resistance is performed. Specifically, Al may be contained in an amount of, in mass %:

$0.10 < Al \leq 1.50$.

However, the amount of Al exceeding the predetermined amount leads to the deterioration in thermal conductivity and toughness.

Chemical Components: S, Ca, Se, Te, Bi, and Pb

Die-casting die has very complicated shape, and therefore is required to have good machinability. Practical machinability is exhibited in the Si content in the level of the steel of the present invention. For further improvement in machinability, free-cutting elements may be added. Specifically, at least one element of S, Ca, Se, Te, Bi, and Pb may be contained in amounts of, in mass %:

$0.008 < S \leq 0.200$, $0.0005 < Ca \leq 0.2000$, $0.03 < Se \leq 0.50$, $0.005 < Te \leq 0.100$, $0.01 < Bi \leq 0.50$, and $0.03 < Pb \leq 0.50$.

The amount of each element exceeding the predetermined amount leads to the saturation of machinability, the deterioration in hot workability, and the deteriorations in the impact value and mirror polishability.

EXAMPLES

Steel materials were obtained from 19 kinds (A to S) of steels shown in Table 1 below by changing annealing conditions. Ac3 transformation point, hardness (HRB) after annealing, largest ferritic grain size, area ratio and average grain size of carbides, largest prior austenitic grain size after quenching, and impact value after tempering of those steel materials obtained were examined.

The annealed steel material of the present invention is assumed to be used as a material for a large die for die-casting or hot forging. In such a use, a narrow range of $4.80 \leq Cr \leq 6.00$ (mass %) is essential from the standpoints of hardenability during quenching, softening resistance and thermal conductivity. Therefore, in conformity with the actual situation, the effect was verified based on steel materials containing $4.80 \leq Cr \leq 6.00$. In Table 1, steels A to N, R and S are that the amount of each element added is within the range of the present invention. On the other hand, steels O, P and Q are that the amount of at least one element added is outside the range of the present invention.

TABLE 1

| | Chemical components (mass %, a remainder being Fe) | | | | | | | |
|---|---|---|---|---|---|---|---|---|
| Steel | C | Si | Mn | Cr | Mo | V | N | Others |
| A | 0.39 | 0.93 | 0.45 | 5.19 | 1.19 | 0.87 | 0.019 | |
| B | 0.35 | 0.48 | 0.71 | 5.53 | 1.26 | 0.58 | 0.019 | |
| C | 0.36 | 0.08 | 0.46 | 5.37 | 1.21 | 0.57 | 0.021 | |
| D | 0.35 | 0.28 | 0.82 | 5.75 | 2.46 | 0.53 | 0.020 | |
| E | 0.35 | 0.27 | 1.12 | 5.51 | 2.51 | 0.56 | 0.019 | |
| F | 0.34 | 0.03 | 0.59 | 5.54 | 3.02 | 0.93 | 0.018 | |
| G | 0.38 | 0.07 | 0.81 | 5.78 | 1.60 | 0.79 | 0.021 | |

TABLE 1-continued

| Steel | Chemical components (mass %, a remainder being Fe) | | | | | | | |
|---|---|---|---|---|---|---|---|---|
| | C | Si | Mn | Cr | Mo | V | N | Others |
| H | 0.31 | 0.19 | 0.22 | 5.85 | 0.92 | 0.48 | 0.003 | 0.58Cu |
| I | 0.28 | 0.70 | 0.35 | 5.96 | 0.83 | 1.09 | 0.008 | 0.96Ni |
| J | 0.30 | 1.20 | 0.99 | 4.83 | 0.92 | 1.01 | 0.044 | 1.26W |
| K | 0.41 | 0.59 | 0.90 | 5.02 | 1.81 | 0.41 | 0.068 | 0.98Co |
| L | 0.40 | 1.12 | 1.18 | 5.11 | 1.44 | 0.62 | 0.031 | 0.03Nb |
| M | 0.37 | 0.82 | 1.09 | 5.54 | 2.03 | 0.70 | 0.056 | 0.12S |
| N | 0.33 | 1.33 | 0.65 | 5.83 | 2.75 | 1.17 | 0.013 | 0.41Cu, 0.60Ni |
| O | 0.26 | 1.01 | 0.46 | 5.21 | 1.20 | 0.36 | 0.019 | |
| P | 0.48 | 1.08 | 0.44 | 5.20 | 3.36 | 1.42 | 0.021 | |
| Q | 0.35 | 0.27 | 1.54 | 4.84 | 2.06 | 0.60 | 0.022 | |
| R | 0.38 | 0.38 | 0.40 | 4.91 | 1.05 | 0.81 | 0.020 | 0.07Ti, 0.005B |
| S | 0.39 | 1.02 | 0.77 | 5.22 | 1.24 | 0.97 | 0.013 | 0.25Al |

The steel materials used for the evaluation were prepared as follows. Each steel having a chemical composition shown in Table 1 was melted, cast in an ingot of 2 tons, and then maintained at 1,240° C. for 24 hours for homogenization treatment. The steel material was formed into a rectangular cross-section having a width of 450 mm and a height (thickness) of 200 mm by forging. The steel material forged was tempered by maintaining at 760° C. for 8 hours as an intermediate heat treatment.

Test piece for measurement of Ac3 transformation point, a small block (for heat treatment test) of 10 mm×10 mm×20 mm and a square bar (for impact test piece) of 11 mm×11 mm×55 mm were prepared from the central part (top side of original ingot before forging) of the tempered material. Those were subjected to 3 heat treatment tests having different annealing conditions. If a block having a size of 450 mm width×200 mm thickness is directly used in a test for investigating structure change through the annealing treatment, a large-scale apparatus is required for the test. Therefore, the test was efficiently conducted with the small block above by introducing a technique to give "thermal history simulating a material with a large cross-section". Of course, because the test gives thermal history exactly simulating a material with a large cross-section, the phenomenon occurred in the actual material with a large cross-section is reproduced.

Heat treatment test 1(Annealing one time at [Ac3 transformation point −20° C.]<Annealing temperature≤[Ac3 transformation point +60° C.])

First, Ac3 transformation point was judged from dimensional change of a test piece during heating from room temperature to 1,100° C. in a rate of 200° C./hr. Next, the small block of 10 mm×10 mm×20 mm was annealed. Prior to the annealing treatment, the small block was heated at 1,240° C. for 1 hour simulating a hot working in an actual production to coarsen grains, and then cooled to room temperature. Thereafter, the small block was annealed. The annealing treatment was steps of heating the steel material (small block) to [Ac3 transformation point −20° C.]<Annealing temperature≤[Ac3 transformation point +60° C.], maintaining at the annealing temperature for 2 hours, cooling to 600° C. in a rate of 20° C./hr, and then naturally cooling. The number of the annealing treatment was only one. After annealing, HRB hardness was measured and then, after etching with an acid, the largest ferritic grain size (perfect circle equivalent diameter), area ratio of carbides, and average particle diameter of carbides were evaluated. The largest ferritic grain size (perfect circle equivalent diameter) was obtained by the method described above.

After completion of the quantification of the annealed microstructure, the annealed steel material was subjected to a quenching of heating to 1,030° C., maintaining at 1,030° C. for 1 hour, and then rapid cooling. The quenched steel material was etched with an acid to expose the grain boundary of prior austenitic grains of 1,030° C., the largest prior austenitic grain was selected, and its perfect circle equivalent diameter was obtained. The perfect circle equivalent diameter of the largest prior austenitic grain was obtained in the same procedure as in the largest ferritic grain size.

The square bar (for impact test piece) of 11 mm×11 mm×55 mm was also subjected to 1,240° C. heating (simulating forging working), annealing and quenching under the same conditions as in the small block, and then, subjected to several times of tempering at 580° C. to 600° C., thereby adjusting hardness to 46HRC. The impact value of the adjusted material was evaluated at room temperature.

The results obtained are shown in Table 2 below.

TABLE 2

| | Steel material | Steel | Ac3 (° C.) | Annealing (° C.) | Annealing −Ac3 (° C.) | HRB | Largest ferritie grain size of annealed material (μm) | Carbide Area ratio (%) | Carbide Average particle diameter (μm) | Largest austenitie grain size after quenching (μm) | Impact value after tempering (J/cm$^2$) |
|---|---|---|---|---|---|---|---|---|---|---|---|
| Comp. Ex. | 01 | A | 890 | 915 | 25 | 91 | 168 | 5.9 | 0.24 | 213 | 25 |
| | 02 | B | 883 | 900 | 17 | 91 | 172 | 5.1 | 0.23 | 197 | 23 |
| | 03 | C | 856 | 900 | 44 | 90 | 161 | 5.2 | 0.21 | 183 | 23 |
| | 04 | D | 851 | 900 | 49 | 91 | 177 | 7.0 | 0.23 | 224 | 21 |
| | 05 | E | 862 | 900 | 38 | 89 | 181 | 7.3 | 0.24 | 191 | 23 |
| | 06 | F | 859 | 900 | 41 | 91 | 173 | 8.0 | 0.19 | 202 | 22 |
| | 07 | G | 861 | 900 | 39 | 91 | 167 | 4.6 | 0.20 | 215 | 24 |
| | 08 | H | 880 | 900 | 20 | 89 | 174 | 3.3 | 0.21 | 187 | 25 |
| | 09 | I | 857 | 900 | 43 | 90 | 173 | 3.2 | 0.25 | 206 | 22 |
| | 10 | J | 888 | 915 | 27 | 87 | 180 | 4.2 | 0.26 | 212 | 21 |
| | 11 | K | 874 | 900 | 26 | 89 | 175 | 6.7 | 0.23 | 190 | 23 |
| | 12 | L | 876 | 900 | 24 | 92 | 174 | 7.0 | 0.25 | 203 | 23 |
| | 13 | M | 872 | 900 | 28 | 90 | 162 | 5.5 | 0.22 | 205 | 22 |
| | 14 | N | 897 | 915 | 18 | 94 | 163 | 5.0 | 0.27 | 182 | 24 |
| | 15 | O | 891 | 915 | 24 | 89 | 171 | 4.1 | 0.22 | 201 | 16 |
| | 16 | P | 901 | 915 | 14 | 93 | 173 | 10.6 | 0.24 | 243 | 11 |
| | 17 | Q | 853 | 900 | 47 | 111 | 291 | 4.9 | 0.24 | 276 | 13 |

TABLE 2-continued

| Steel material | Steel | Ac3 (° C.) | Annealing (° C.) | Annealing −Ac3 (° C.) | HRB | Largest ferritie grain size of annealed material (μm) | Carbide Area ratio (%) | Carbide Average particle diameter (μm) | Largest austenitie grain size after quenching (μm) | Impact value after tempering (J/cm$^2$) |
|---|---|---|---|---|---|---|---|---|---|---|
| 18 | R | 853 | 900 | 47 | 90 | 170 | 6.0 | 0.23 | 203 | 23 |
| 19 | S | 891 | 915 | 24 | 90 | 165 | 6.1 | 0.25 | 192 | 24 |

In the steel materials 01 to 19 (Comparative Examples) shown in Table 2, the heating temperature when annealing was 14 to 49° C. higher than Ac3 transformation point. Regarding the hardness of the annealed steel materials, only the steel material 17 (steel Q) had a hardiness of 111 HRB outside the requirement (100 HRB or less) of the present invention. The steel material 17 has very good hardenability during quenching and due to this, has poor annealing property. Therefore, the steel material 17 had a mixed structure in which the vicinity of the grain boundary of coarse grains softened (the structure was ferrite and spherical carbide) and the inside of coarse grains was hard (the structure was bainite and martensite).

The structure of each of the annealed steel materials 01 to 19 was coarse, and the largest ferritic grain size present on the observation surface did not satisfy 120 μm or less that is the requirement of the present invention. The annealed state of the annealed steel materials 01 to 19 was the microstructure like FIG. 3B, and there remained strongly the influence of coarse grains formed when heating at 1,240° C. simulating a hot working. The annealed steel materials 01 to 19 satisfied the requirement of the area ratio of carbides required in the present invention, except for the steel material 16. All of the annealed steel materials 01 to 19 satisfied the requirement of the average particle diameter of carbides required in the present invention.

The microstructure of the steel materials after quenching was coarse similar to the microstructure after annealing. The largest prior austenitic grain size present on the observation surface did not satisfy 100 μm or less that is intended in the present invention. The quenched state of the quenched steel materials 01 to 19 was the microstructure like FIGS. 3C and 3D, and fine grains were interspersed in the grain boundary of coarse grains. Thus, because the structure was coarse, none of the steel materials showed an impact value exceeding 25 J/cm$^2$ that is conventionally required as a die. In the steel material 16 containing large amount of carbide forming elements, coarse carbides of 5 μm or more are liable to be densely formed, which remain to serve as the origin of fracture. Therefore, the steel material 16 had a particularly low impact value. The steel materials 01 to 19 shown in Table 2 had low levels of impact value. Therefore, if dies are actually manufactured from those steel materials, the fracture of the dies in an early stage is a concern.

As demonstrated above, even though the chemical compositions and annealing temperature are within the scope of the present invention, the annealed microstructure specified in the present invention cannot be obtained by one-time annealing treatment, and therefore the structure and impact value after quenching are also not desirable state.

Heat treatment test 2(Annealing three times at [Ac3 transformation point −20° C.]<Annealing temperature≤[Ac3 transformation point +60° C.])

The case where the chemical compositions and annealing temperature are within the scope of the present invention and the annealing treatment is repeated three times in total was verified. To the steel materials, the heating at 1,240° C. was conducted one time, the annealing treatment was conducted at the same temperature as in the case of Heat treatment test 1 three times, and the quenching at 1,030° C. was conducted. The conditions other than the number of the annealing treatment were the same as in the case of Heat treatment test 1. The results obtained are shown in Table 3 below.

TABLE 3

| | Steel material | Steel | Ac3 (° C.) | Annealing (° C.) | Annealing −Ac3 (° C.) | HRB | Largest ferritie grain size of annealed material (μm) | Carbide Area ratio (%) | Carbide Average particle diameter (μm) | Largest austenitie grain size after quenching (μm) | Impact value after tempering (J/cm$^2$) |
|---|---|---|---|---|---|---|---|---|---|---|---|
| Ex. | 21 | A | 890 | 915 | 25 | 89 | 24 | 6.7 | 0.25 | 23 | 56 |
| | 22 | B | 883 | 900 | 17 | 88 | 63 | 5.8 | 0.24 | 56 | 53 |
| | 23 | C | 856 | 900 | 44 | 87 | 59 | 5.4 | 0.21 | 52 | 55 |
| | 24 | D | 851 | 900 | 49 | 87 | 66 | 7.9 | 0.24 | 52 | 52 |
| | 25 | E | 862 | 900 | 38 | 87 | 65 | 8.2 | 0.24 | 53 | 53 |
| | 26 | F | 859 | 900 | 41 | 88 | 31 | 8.7 | 0.21 | 24 | 53 |
| | 27 | G | 861 | 900 | 39 | 87 | 30 | 5.3 | 0.21 | 26 | 58 |
| | 28 | H | 880 | 900 | 20 | 86 | 92 | 4.3 | 0.22 | 73 | 55 |
| | 29 | I | 857 | 900 | 43 | 86 | 25 | 4.1 | 0.25 | 24 | 52 |
| | 30 | J | 888 | 915 | 27 | 88 | 25 | 4.6 | 0.27 | 23 | 51 |
| | 31 | K | 874 | 900 | 26 | 87 | 98 | 7.3 | 0.25 | 72 | 55 |
| | 32 | L | 876 | 900 | 24 | 90 | 28 | 7.3 | 0.26 | 25 | 53 |
| | 33 | M | 872 | 900 | 28 | 89 | 24 | 5.6 | 0.23 | 24 | 54 |
| | 34 | N | 897 | 915 | 18 | 90 | 24 | 5.3 | 0.28 | 22 | 54 |

TABLE 3-continued

| | Steel material | Steel | Ac3 (° C.) | Annealing (° C.) | Annealing −Ac3 (° C.) | HRB | Largest ferritie grain size of annealed material (μm) | Carbide Area ratio (%) | Carbide Average particle diameter (μm) | Largest austenitie grain size after quenching (μm) | Impact value after tempering (J/cm$^2$) |
|---|---|---|---|---|---|---|---|---|---|---|---|
| Comp. | 35 | O | 891 | 915 | 24 | 86 | 32 | 4.5 | 0.23 | 201 | 15 |
| Ex. | 36 | P | 901 | 915 | 14 | 91 | 26 | 10.9 | 0.26 | 25 | 13 |
| | 37 | Q | 853 | 900 | 47 | 109 | 235 | 5.8 | 0.24 | 228 | 17 |
| Ex. | 38 | R | 853 | 900 | 47 | 89 | 41 | 6.2 | 0.24 | 37 | 53 |
| | 39 | S | 891 | 915 | 24 | 89 | 36 | 6.4 | 0.25 | 31 | 53 |

As shown in Table 3, regarding the hardness of annealed steel materials, only the steel material 37 had a hardness of 109 HRB outside the requirement of the present invention. The steel material 37 had a mixed structure in which the vicinity of the grain boundary of coarse grains softened (the microstructure was ferrite and spherical carbides) and the inside of the coarse grains was hard (the microstructure was bainite and martensite), similar to the case of the steel material 17. The steel material 37 had a spread softened region and somewhat decreased hardness as compared with the case of the steel material 17, but this hardness still has a problem in machinability when forming into a die shape.

The microstructure of each of the annealed steel materials 21 to 39 other than the steel material 37 was fine, and the largest ferritic grain size satisfied 120 μm or less that is the requirement of the present invention. The annealed state of the annealed steel materials 21 to 39 other than the steel material 37 was the microstructure like FIG. 4B, and there remained no influence of coarse grains formed when heating at 1,240° C. simulating a hot working. The annealed steel materials 21 to 39 other than the steel material 37 satisfied the requirement of the area ratio of carbides required in the present invention. All of the annealed steel materials 21 to 39 satisfied the requirement of the average particle diameter of carbides required in the present invention.

Regarding the largest prior austenitic grain size after quenching, the steel materials 35 and 37 did not satisfy 100 μm or less that is intended in the present invention. The steel material 35 had a small amount of carbides suppressing movement of austenitic grain boundary at quenching temperature, and as a result, grains grown. The steel material 37 received the influence of the coarse particles in the annealed state in which the softening was not sufficient.

The quenched state of the steel materials 21 to 39 other than the steel materials 35 and 37 was the microstructure like FIGS. 4C and 4D, and the entire surface was fine-grained. Thus, because the structure was fine, the steel materials 21 to 39 other than the steel materials 35 and 37 achieved, after tempering, an impact value exceeding 25 J/cm$^2$ that is conventionally required as a die. If dies are actually manufactured from those steel materials, it is expected that the dies do not fracture in an early stage. However, in the steel material 36 containing a large amount of carbide forming elements, coarse carbides of 5 μm or more are liable to be densely formed, which remain and serve as the origin of fracture. Therefore, the steel material 36 had a low impact value even though grains were fine.

As demonstrated above, in order to maintain austenitic grains at quenching temperature in a fine state, the annealed state must be soft and fine and many carbides must be dispersed at quenching. In the case where the chemical compositions and annealing temperature are within the scope of the present invention as in the steel materials 21 to 34, 38 and 39 (Examples), the annealed microstructure specified in the present invention can be obtained by performing a plural times of annealing treatment, and as a result, the desirable microstructure and impact value after quenching can be achieved.

Heat treatment test 3(Annealing three times at annealing temperature≤[Ac3 transformation point −20° C.])

The case where the heating temperature at annealing is [Ac3 transformation point −20° C.] or lower was verified. The annealing condition of this test deviated from the scope of the present invention. The test was conducted to confirm that even though the chemical compositions of a steel material are within the scope of the present invention, sufficient effect cannot be achieved if the annealing condition is not appropriate.

In the steel materials 41 to 56 (Comparative Examples) shown in Table 4, the steels A to N, R and S shown in Table 1 were used. Those steels have chemical compositions within the scope of the present invention. The steel materials 41 to 56 were heated at 1,240° C. for 1 hour simulating a hot working, and then repeatedly subjected to an annealing treatment three times in total. The respective annealing treatment was steps of heating the steel material to an annealing temperature of [Ac3 transformation point −20° C.] or lower, maintaining at the annealing temperature for 2 hours, cooling to 600° C. in a rate of 20° C./hr, and then naturally cooling. The annealed steel materials were evaluated in accordance with the verification described in Table 2.

The square bar (for impact test piece) of 11 mm×11 mm×55 mm was subjected to a heating at 1,240° C. simulating a hot working one time, annealing treatments at an annealing temperature≤[Ac3 transformation point −20° C.] three times, a quenching at 1,030° C., and then a tempering to adjust the hardness to 46HRC. The impact value of the adjusted material was evaluated in accordance with the verification described in Table 2.

The results obtained are shown in Table 4 below.

TABLE 4

| | Steel material | Steel | Ac3 (° C.) | Annealing (° C.) | Annealing −Ac3 (° C.) | HRB | Largest ferritie grain size of annealed material (μm) | Carbide Area ratio (%) | Carbide Average particle diameter (μm) | Largest austenitie grain size after quenching (μm) | Impact value after tempering (J/cm$^2$) |
|---|---|---|---|---|---|---|---|---|---|---|---|
| Comp. Ex. | 41 | A | 890 | 860 | −30 | 89 | 220 | 5.5 | 0.21 | 207 | 23 |
| | 42 | B | 883 | 850 | −33 | 90 | 209 | 4.7 | 0.20 | 214 | 21 |
| | 43 | C | 856 | 830 | −26 | 90 | 214 | 4.9 | 0.19 | 196 | 22 |
| | 44 | D | 851 | 820 | −31 | 89 | 236 | 6.6 | 0.21 | 222 | 22 |
| | 45 | E | 862 | 830 | −32 | 88 | 231 | 7.0 | 0.22 | 227 | 22 |
| | 46 | F | 859 | 820 | −39 | 90 | 217 | 7.2 | 0.17 | 210 | 19 |
| | 47 | G | 861 | 820 | −41 | 91 | 223 | 4.1 | 0.18 | 192 | 23 |
| | 48 | H | 880 | 840 | −40 | 88 | 205 | 3.1 | 0.20 | 190 | 21 |
| | 49 | I | 857 | 820 | −37 | 89 | 212 | 2.9 | 0.22 | 223 | 18 |
| | 50 | J | 888 | 850 | −38 | 86 | 198 | 3.9 | 0.23 | 206 | 24 |
| | 51 | K | 874 | 840 | −34 | 88 | 218 | 6.5 | 0.21 | 211 | 23 |
| | 52 | L | 876 | 840 | −36 | 91 | 216 | 6.9 | 0.24 | 215 | 23 |
| | 53 | M | 872 | 840 | −32 | 90 | 197 | 5.1 | 0.20 | 204 | 22 |
| | 54 | N | 897 | 860 | −37 | 93 | 203 | 4.8 | 0.24 | 201 | 23 |
| | 55 | R | 853 | 820 | −33 | 91 | 211 | 5.8 | 0.22 | 210 | 22 |
| | 56 | S | 891 | 860 | −31 | 92 | 202 | 5.7 | 0.23 | 196 | 22 |

As shown in Table 4, the annealing temperature was 26° C. to 41° C. lower than Ac3 transformation point. All of the annealed steel materials 41 to 56 had a hardness of 100 HRB or less. However, any of these steel materials had a coarse microstructure in the annealed state, and the largest ferritic grain present on the observation surface did not satisfy 120 μm or less that is the requirement of the present invention. The annealed state of the annealed steel materials 41 to 56 was the microstructure like FIG. 5B, and there remained strongly the influence of coarse grains formed when heating at 1,240° C. simulating a hot working. Because the heating temperature at annealing was lower than Ac3 transformation point, the microstructure of the steel material annealed was basically similar to high temperature-tempered martensite, and only the vicinity of the grain boundary, which had been austenitized exceeding Ac1 transformation point, transformed into ferrite and spherical carbides. The area ratio and size of the carbides were smaller than those in the case where the annealing temperature exceeds Ac3 transformation point. Specifically, the area ratio of the carbides in the steel material 49 was lower than 3.0% that is the lower limit of the area ratio in the present invention, and the average particle diameter of the carbides in the steel material 46 is lower than 0.18 μm that is the lower limit of the average particle diameter in the present invention.

The microstructure of the steel material after quenching was coarse similar to the structure after annealing. In all steel materials 41 to 56, the largest prior austenitic grain size present on the observation surface did not satisfy 100 μm or less that is intended in the present invention. The quenched state of the quenched steel materials 41 to 56 was the microstructure like FIGS. 5A to 5D, and fine grains were interspersed in the grain boundary of coarse grains. Thus, due to such a coarse structure, none of the steel materials 41 to 56 showed an impact value exceeding 25 J/cm$^2$ that is conventionally required as a die after tempering. Therefore, if dies are actually manufactured from these steel materials, the fracture of the dies in an early stage is a concern. As described above, even though the chemical compositions are within the scope of the present invention, unless the annealing conditions are appropriate, the annealed structure specified in the present invention cannot be obtained. Accordingly, it could be confirmed that unless the annealing conditions are appropriate, the structure and impact value after quenching are not in the desirable state.

Examples of the present invention have been described in detail above, but those examples are merely exemplified embodiments. The annealed steel material of the present invention is suitable for use in dies and parts for injection molding of plastics, molding and processing of rubbers, molding of CFRP, various castings, warm working, hot forging, hot stamp, and the like. The annealed steel material of the present invention can be combined with surface modification (shot blast, sand blast, nitriding, PVD treatment, CVD treatment, plating, etc.). Furthermore, the annealed steel material of the present invention can be formed into a rod shape or a wire shape and used for welding repair of a main body or parts of a die. The present invention can be applied to a die or parts manufactured by additive manufacturing of a plate or a powder. The present invention can be carried out in an embodiment to which various modifications have been added in scope that does not deviate from the gist thereof.

The present application is based on Japanese Patent Application No. 2017-063911 filed on Mar. 28, 2017 and Japanese Patent Application No. 2018-003470 filed on Jan. 12, 2018, which contents are incorporated herein by reference.

What is claimed is:

1. An annealed steel material having a composition consisting of, in mass %:

$0.28 \leq C < 0.42$,
$0.01 \leq Si \leq 1.50$,
$0.20 \leq Mn \leq 1.20$,
$4.80 \leq Cr \leq 6.00$,
$0.80 \leq Mo \leq 3.20$,
$0.40 \leq V \leq 1.20$, and
$0.002 \leq N \leq 0.080$,
with a balance being Fe and unavoidable impurities, and optionally,
$Cu \leq 1.00$,
$Ni \leq 1.50$,
$B \leq 0.0050$,
$W \leq 5.00$, Co≤4.00,
Nb≤0.100,
Ta≤0.100,
Ti≤0.100,
Zr≤0.100,
Al≤1.50,
S≤0.200,
Ca≤0.2000,
Se≤0.50,
Te≤0.100,
Bi≤0.50, and
Pb≤0.50, wherein the annealed steel material has:

a cross-sectional size of a thickness of 200 min or more and a width of 250 mm or more; and a hardness of 100 HRB or less, wherein, when a cross-section of the annealed steel material is polished, corroded with an acid to expose a metallic structure, and observed with an optical microscope, a diameter of a largest ferritic gain observed in the metallic structure in a state after annealing is 120 μm or less in terms of a perfect circle equivalent, an area ratio of carbides is 3.0% or more and less than 10.5%, in which the area ratio is obtained by an equation of Area ratio (%)=100xs/A from a total area "s" of carbides present in a cumulative area A of plural visual fields observed in 5,000 magnifications, the cumulative area A of the plural visual fields being in a range from 4,000 $\mu m^2$ to 5,000 $\mu m^2$, and an average particle diameter of the carbides is 0.18 μm or more and 0.29 μm or less, in which when an average area C=s/n is calculated from the total area "s" of the carbides and a total number "n" of the carbides, the average particle diameter of the carbides is a diameter of an assumed perfect circle having an area of C, and wherein the carbides are spherical carbides uniformly dispersed, and the metallic structure is in the state after the annealing and before quenching.

2. The annealed steel material according to claim 1, wherein the composition comprises, in mass %, at least one of:

0.30≤Cu≤1.00, and 0.30≤Ni≤1.50.

3. The annealed steel material according to claim 1, wherein the composition comprises, in mass %:

0.0001<B≤0.0050.

4. The annealed steel material according to claim 1, wherein the composition comprises, in mass %, at least one of:

0.30<W≤5.00, and 0.30<Co≤4.00.

5. The annealed steel material according to claim 1, wherein the composition comprises, in mass %, at least one of:

0.004<Nb≤0.100, 0.004<Ta≤0.100, 0.004<Ti≤0.100, and 0.004<Zr≤0.100.

6. The annealed steel material according to claim 1, wherein the composition comprises, in mass %:

0.10<Al≤1.50.

7. The annealed steel material according to claim 1, wherein the composition comprises, in mass %, at least one of:

0.008<S≤0.200, 0.0005<Ca≤0.2000, 0.03<Se≤0.50, 0.005<Te≤0.100, 0.01<Bi≤0.50, and 0.03<Pb≤0.50.

8. A method for manufacturing the annealed steel material described in claim 1, the method comprising performing a plural times of an annealing treatment on a steel material, wherein the annealing treatment comprises heating the steel material to a temperature exceeding [Ac3 transformation point −20° C.] and [Ac3 transformation point +60° C.] or lower.

9. The annealed steel material according to claim 1, wherein the area ratio of carbides is in a range front 3.2% to 10.0%.

10. The annealed steel material according to claim 1, wherein the composition comprises, in mass %:

0.03≤Si≤1.20.

11. The annealed steel material according to claim 1, wherein the composition comprises, in mass %:

1.00≤Mo≤3.10.

12. The annealed steel material according to claim 1, wherein the composition comprises, in mass %:

0.48≤V≤1.10.

13. The annealed steel material according to claim 1, wherein the composition comprises, in mass %, 0.41≤V≤1.00.

14. The annealed steel material according to claim 1, wherein the composition comprises, in mass %, 0.60≤Ni≤1.50.

* * * * *